US005371982A

United States Patent [19]

Douglas et al.

[11] Patent Number: 5,371,982

[45] Date of Patent: Dec. 13, 1994

[54] PORTABLE AREA SECURITY ENCLOSURE KIT

[75] Inventors: James W. Douglas, Catonsville; Robert H. Greene, Jr., Baltimore, both of Md.; Harry Hopkins, Williamston, N.C.

[73] Assignee: Hopkins International, Inc., Baltimore, Md.

[21] Appl. No.: 894,810

[22] Filed: Jun. 8, 1992

[51] Int. Cl.[5] ..... E04B 1/346; E04B 7/16

[52] U.S. Cl. ..... 52/64; 52/71; 52/243.1; 52/581

[58] Field of Search ..... 52/64, 71, 243.1, 581, 52/586; 135/102, 103, 111, 112

[56] References Cited

U.S. PATENT DOCUMENTS

| | | | |
|---|---|---|---|
| 2,406,559 | 8/1946 | Oakes | 52/581 X |
| 3,629,982 | 12/1971 | Ballay et al. | 52/71 X |
| 3,731,440 | 5/1973 | Welz | 52/71 |
| 3,766,692 | 10/1973 | Stark et al. | 52/71 |
| 4,150,682 | 4/1979 | Ryce | 135/103 |
| 4,815,736 | 3/1989 | Wright | 135/102 |
| 4,844,109 | 7/1989 | Navarro | 135/103 |
| 4,932,172 | 6/1990 | Maas | 52/71 |

*Primary Examiner*—Neill R. Wilson
*Attorney, Agent, or Firm*—Darby & Darby

[57] ABSTRACT

A portable security wall for isolating an area on the ground includes an enclosure wall comprised of a plurality of sections, a plurality of post members for mounting the wall on the ground, and a plurality of weighted post support members for supporting the post members. The wall can be made of separate rigid sections or, alternatively, a continuous flexible band with a plurality of longitudinally-spaced pockets for receiving the post members. The pockets define the sections of the wall. The wall can also be made of separate flexible sections which may be wound on or unwound from elongated shaft members by applying a rotary force, e.g., through use of a motor. The wall may be made tall to block the public's view of the area and two tall walls may be connected together to form a canopy.

32 Claims, 6 Drawing Sheets

PORTABLE AREA SECURITY ENCLOSURE KIT

BACKGROUND OF THE INVENTION

The invention relates to a portable security enclosure kit for enclosing an area on the ground. In particular, the invention relates to a portable area security enclosure kit for use by city, county and state police, private security guards, as well as medical teams to isolate the areas surrounding an accident.

At present, police barriers, i.e., wooden saw horses or yellow tape mounted on spaced post members or barriers, are used to isolate the area of an accident or crime scene. While isolating the area, neither the barriers nor the tape permit operation of a medical team or police officers free of interference or distraction from onlookers who, at least orally, may interfere with operation of the medical and/or police team. There is a need for an enclosure that isolates the police and/or medical team from the public and allows them to operate without distraction and interference.

When celebrities are entering or leaving a facility, such as an arena or hotel, it is a benefit to private security guards to be able to block the public's view of their movements as a means of crowd control. The same applies to court officers in connection with high profile criminal cases. Also, people with video cameras, both professional news people and private citizens, may record and subsequently disclose the arrangement of a crime scene. This may impede an investigation by disclosing information to the general public which would otherwise be known only by the police and the criminal.

SUMMARY OF THE INVENTION

The present invention is directed to a portable area security enclosure that can be quickly erected to isolate the area surrounding any accident or crime scene and that permits a police and/or medical team to operate without interference and distraction. In one form, this enclosure blocks the public's view of the area.

According to an illustrative embodiment of the invention, there is provided a portable area security enclosure kit that includes (1) an enclosure wall in the form of a plurality of sections having predetermined lengths and widths, (2) a plurality of post members for vertically mounting the enclosure wall on the ground, and (3) a plurality of support members for supporting the post members, and thereby the enclosure wall, on the ground. Adjacent sections of the wall have cooperating means at their adjacent vertical ends which are received by a respective post member between them. The support members have openings for receiving the lower ends of the post members.

When used along highways, the material of the enclosure wall may have a generally high light-reflecting color so it is visible from a great distance. Regardless of use, the material of the enclosure should be resistant to stains, dirt, etc. and should be easy to clean.

The enclosure wall sections may be formed of rigid plastic plates which are connected to the post members by hinge connections so the enclosure can be folded into a compact shape or expanded to surround an accident area. However, preferably, the enclosure wall is made as a flexible band of material having vertically-spaced pockets which extend at least partially across the width of the band and receive the post members. The flexible band may be in sections extending between posts or it may be a continuous band where the pockets define the lateral edges of the wall sections. It may be desirable to include horizontal rigid members in the wall section to provide additional support of the flexible band between the vertical post members.

If the band is continuous and is looped about the accident area, the two ends of the band will be opposite each other across a gap and will serve as an entrance to the restricted area. A door of similar construction may be hinged to the post member at one end of the band and arranged to swing across the gap to open or close the entrance. The material of the door may include two pairs of diagonally-crossed pockets. Two rod members inserted in the two pairs of pockets, respectively, provide stiffening of the flexible material of the door section.

The upper longitudinal edge of the band may be folded over and fastened to the main portion of the band to create a pocket. This pocket may be open downwardly at locations aligned with the pockets arranged across the width of the band so as to form a plurality of blind holes that receive the upper ends of post members when in the erected condition of the enclosure wall. The post members may be freely received in the pockets and, in that case, they may be packaged separately. Thus, the size of the enclosure when collapsed for shipping can be relatively small. Alternatively, the post member can be fixed in the pockets, e.g., glued therein. In this case, the post members remain with the band. Consequently, the enclosure is easier to transport and erection of the enclosure wall requires less time.

If a flexible band with sections between the post is used with horizontal wall members, the band sections must be detached from the posts if the pockets are made so that they are operable. This may be achieved with zippers, Velcro TM or snaps that open or close the pockets. Should the pockets be opened, the band sections may be wound up on the upper horizontal wall members to reduce the size of the enclosure for shipping purposes. Further, if the horizontal members are made rotatable in the upper parts of the post members and connected to each other by a connection means, all of the flexible wall sections may be wound up on the horizontal members by applying a rotary force, e.g., through use of a motor, to one of the members, preferably at the door. It may be necessary to add some weight at the lower edge of the bands to help lower them when this arrangement is used.

As can be seen from the foregoing discussion, the band of wall material can be easily rolled up and packaged for easy portability.

Another embodiment of the invention is made with relatively high walls, e.g. about seven feet high. These walls block the view of the public from an area. For example, a pair of such high walls may be used to form a passageway through which a celebrity may move from, e.g., a hotel entrance to a waiting limousine, and not be seen. With high winds, it may be necessary to augment the support members with laterally extending legs that attach to each side of the post members.

In addition, if the walls are to stand near a building folded in accordion fashion, extending the walls for use may be facilitated by replacing the weighted, disk-shaped support member with wheels attached to the bottom of each post. Further, wheels may be provided at the ends of the laterally-extending legs where they contact the ground.

If a flexible material is used for the walls, it may be arranged to slide along horizontal rigid wall members so the material can be stored to one side of a wall section. This material may also have slits in it to reduce pressure on the wall from strong winds. Further, the legs may be made so as to telescope for easy storage when not in use.

Thus, according to the invention, there is provided a security enclosure kit which can be easily transported and takes little time to erect, while ensuring isolation of the area of an accident or other occurrence and permitting medical personnel and/or police officers to operate free from interference, distraction and the view of the general public.

BRIEF DESCRIPTION OF THE DRAWINGS

The above-mentioned and other features and objects of the invention, and the manner of obtaining them, will become more apparent and the invention itself will be best understood from the following detailed description of the preferred embodiments of the invention, when read in conjunction with the accompanying drawings, wherein.

DETAILED DESCRIPTION OF THE PREFERRED EMBODIMENTS

Figure 1:
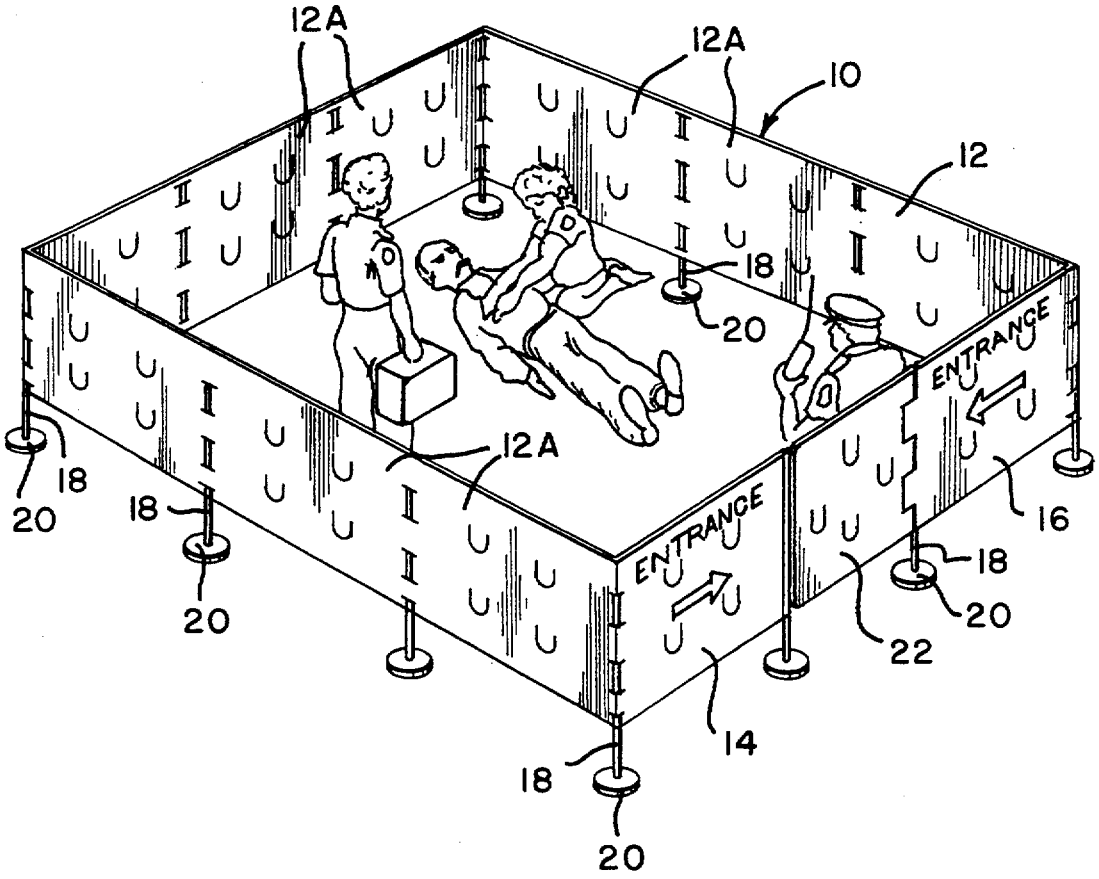
FIG. 1 shows a perspective view of the enclosure according to the invention in an erected condition with a team working at the place of an accident.
Figure 7:
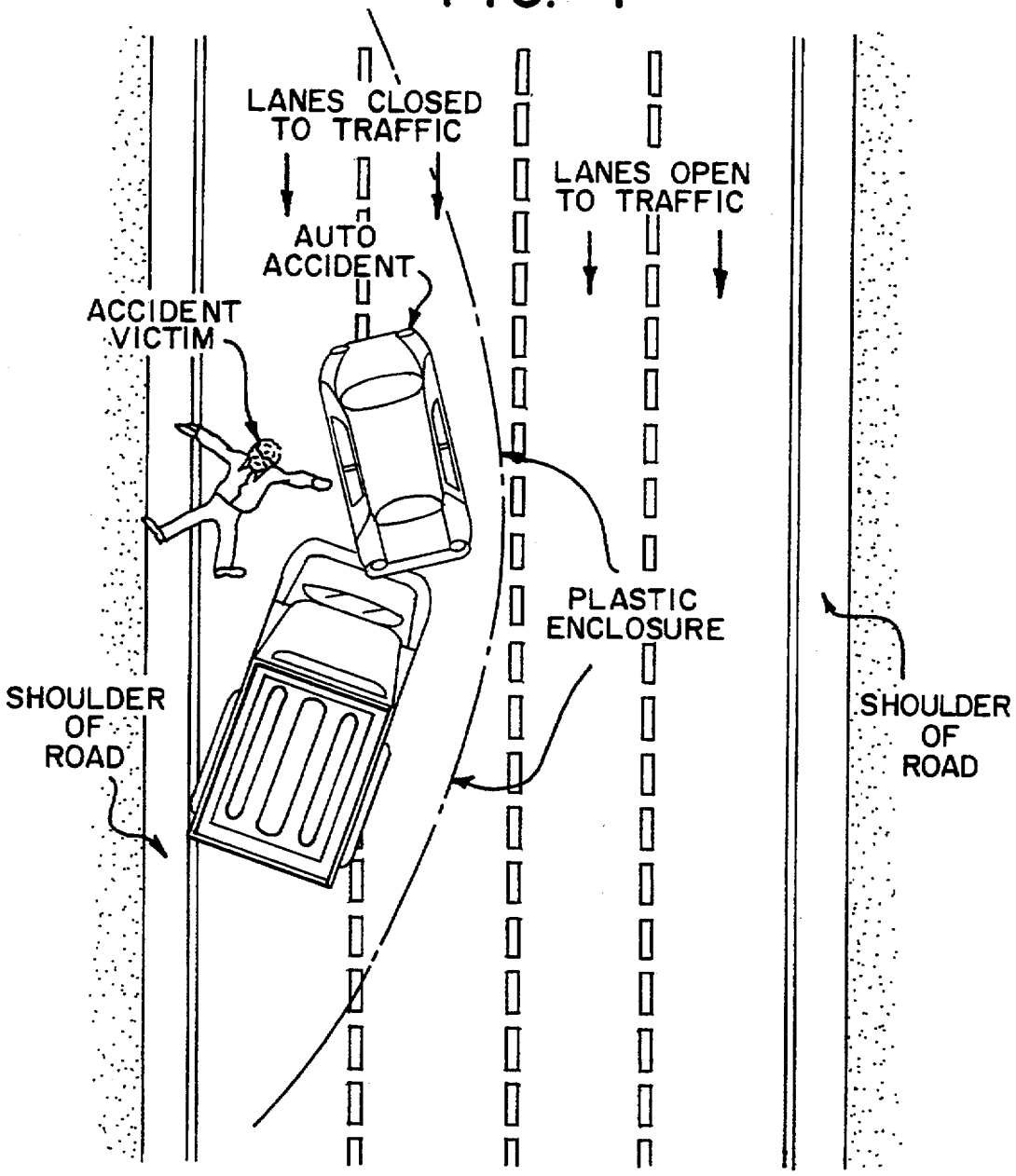
FIG. 7 shows a partial plan view of the enclosure wall used to divert traffic from one highway lane to another and to isolate an area of an accident.

FIG. 1 shows an erected enclosure formed from an enclosure kit according to the present invention. The enclosure 10 includes an enclosure wall 12 comprising a plurality of sections 12A. The enclosure wall shown in FIG. 1 defines a square surrounding the area of an accident. It should be understood that the area does not necessarily have to be a square, but may take other forms. For example, FIG. 7 shows a plan view of an accident scene on a highway where the enclosure is in a semicircle and is used to divert traffic into an adjacent lane.

As can be seen in FIG. 1, one embodiment of the enclosure wall is erected by means of a plurality of post members 18 received in weighted disk-shaped post support members 20. The enclosure wall has a door 22 arranged between two sections 14 and 16. As has already been discussed above, the sections 12A may be formed of rigid plastic plates having hinge elements on opposite ends thereof for receiving post members 18. However, preferably, the enclosure wall 12 is formed as a flexible band of material. The band of material may be continuous and extend past all of the posts or in sections that extend between posts.

Figure 2:
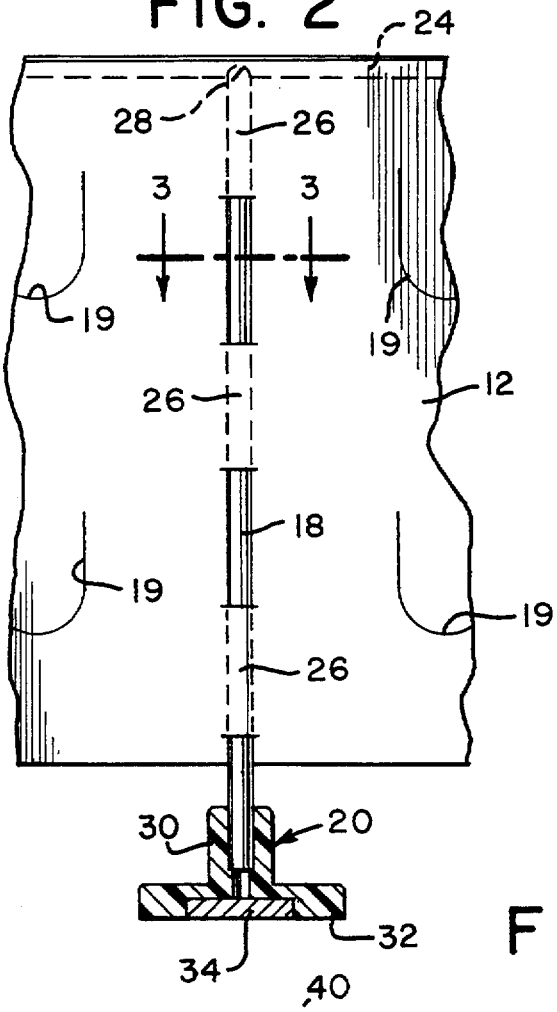
FIG. 2 shows a partial elevational view of the enclosure wall.
Figure 3:
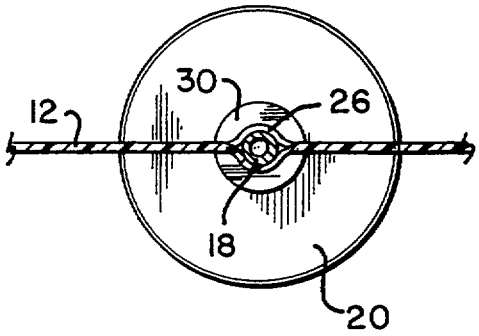
FIG. 3 shows a partial cross-sectional view along lines 3—3 in FIG. 2.

A portion of a continuous band is shown in FIG. 2. As can be seen from the figure, the band may have a plurality of pockets 26, two of which are shown in FIG. 2, extending vertically across the width of the band. A post member 18 is received in the pockets, as shown in cross-section in FIG. 3. The upper longitudinal, i.e., horizontal, edge of the band is folded over and attached to the main part of the band, e.g., by gluing or stretching, to create a further pocket 24. Aligned with the vertical post member 18, there is a hole in pocket 24 so as to form a blind hole 28 into which the upper end of the post member, in the erected condition of the wall, is received.

The post support member 20 has a disk-like portion 32. A weight 34 is located on the ground and is received in a recess of the disk-like portion. An upright portion 30 extends upwardly from the disk-like portion and has an opening for receiving the lower end of the post member 18.

The wall is made of flexible material, preferably of a highly reflective and brightly colored material. Due to the flexibility of the material, the enclosure wall will assume any shape set by the location of the posts. In addition to providing band holes 24, the fold 28 at the top of the band provides some stiffening to limit the amount by which the wall drops between the posts.

When the enclosure must be taken down and transported or stored, the posts can be removed and the band of wall material rolled up so that a small package is formed.

Figure 4:
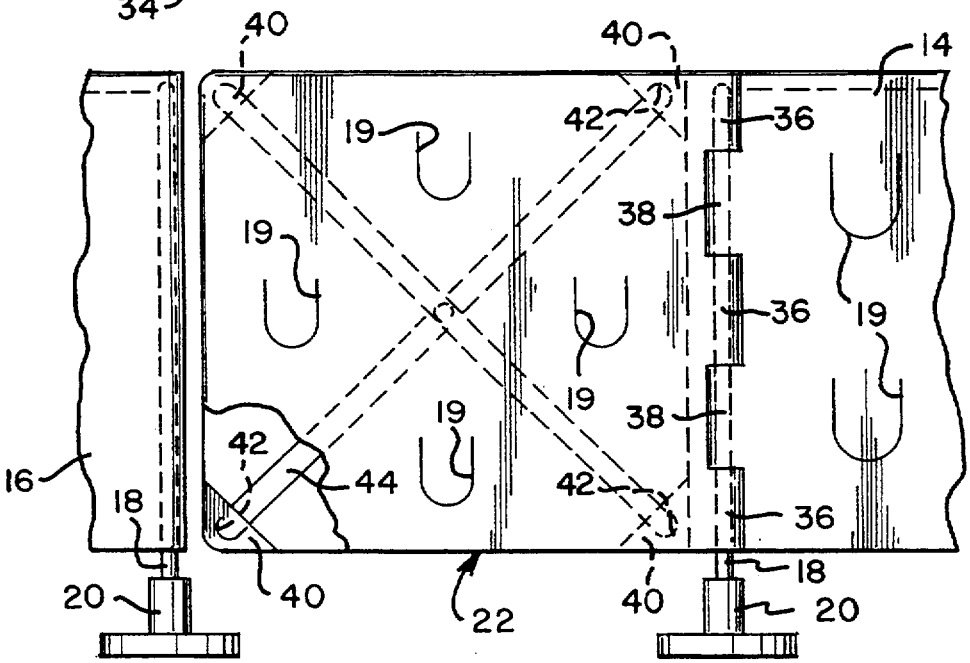
FIG. 4 shows a door section of the enclosure wall.

FIG. 4 shows a door section 22 which can be used when the enclosure closes on itself, as opposed to being open, as in FIG. 7. The door section 22 has hinge elements 36 cooperating with hinge elements 38 of an end section 14 of the enclosure. These hinge elements are located on a post member. As can be seen in FIG. 4, the door section has triangular pieces of cloth 40 at its four corners so as to define blind holes 42. The holes 42 receive crossed rod members 44 that give the door section needed rigidity to enable it to operate. The hinge elements 36 and 38 are hook-like so that they can easily encompass a post member and be detached from the post member. While shown in FIG. 4 as a separate section, the door section 22 may be formed as an end section of the flexible band. The end of a continuous band opposite the door has a channel or pocket in which its post member is received.

In order to reduce wind pressure on the wall, the flexible material may be provided with U-shaped slits 19 (FIGS. 2 and 4) which allow the wind to pass through without providing substantial viewing of the secure area.

Figure 5:
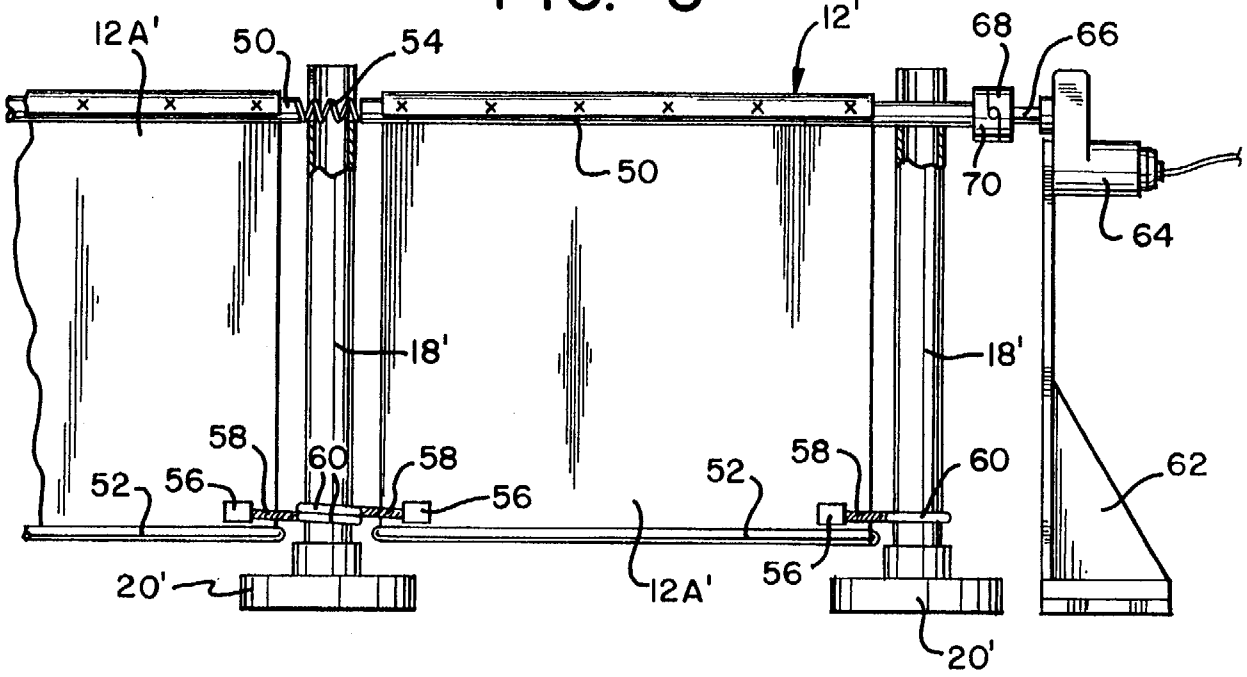
FIG. 5 shows the enclosure wall arranged for raising and lowering flexible band sections with a motor.

Another embodiment of the enclosure wall according to the invention is shown in FIG. 5, in which similar elements are designated by the same numeral, but with an index "′". The enclosure wall 12′ shown in FIG. 5 consists of a plurality of wall sections 12A′. Each wall sections 12A′ is fixedly secured, at one longitudinal edge thereof, to a shaft member 50 and may have, at the opposite longitudinal edge thereof, a rigid rod member 52 to provide stiffness to the wall section in the erected condition. The shaft member 50 is fixedly connected, at one of its opposite ends, with a close wound coil spring 54. The free end of the coil spring 54 is connectable, during the erection of the enclosure, to a free end of the shaft member of an adjacent wall section, as shown in FIG. 5, so that the coil spring 54 is able to transmit rotational torque between two adjacent shaft members 50 to enable winding and unwinding of the wall sections 12A'. The coil springs extend through respective openings in post members 18' which are supported in the post support members 20'. These openings are preferably open at the top of the post to ease insertion and removal of the springs from the posts.

Each wall section 12A' has at its longitudinal edge, where the stiffening rod 52 is provided, opposite lateral patches 56 for receiving respective ends of elastic cords 58 which envelope respective post members in erected and unwound condition of the enclosure wall 12'. The cords 58 may be provided with hooks 60 for engaging the respective post members.

The enclosure kit according to the embodiment shown in FIG. 5 includes a stand 62 which supports a motor 64 used for unwinding and winding wall sections 12A' of the enclosure wall 12'. The motor 64 is preferably an electric motor which may be powered as by a separate battery or from an electrical circuit of a vehicle. The shaft 66 of the motor has at its free end an appropriate quick disconnect coupling member 68 which is connectable with a complementary coupling member 70 which is secured to an end of one shaft member 50 which is opposite to the end at which a respective coil spring 54 is attached. One of the post members 18', instead of an opening for a coil spring, has at its end a U-shaped recess for receiving a shaft portion of the complementary coupling member 70.

The erection of the enclosure wall 12', while clear from the foregoing description, will be described for completeness of the disclosure. When an enclosure is to be erected, the post support members 20' are placed on the ground at a required distance from each other, and the post members 18' are inserted therein. Then, the respective ends of shafts 50 of respective wall sections 12A' are connected with coil springs 54, and the shaft member with the complimentary coupling member 70 is connected to the motor 65. Upon actuation of the motor 64, the enclosure wall 12A' becomes unwound. After the enclosure wall 12A' is unwound, the cords 58 are wound around respective post members 18'.

Figure 6:
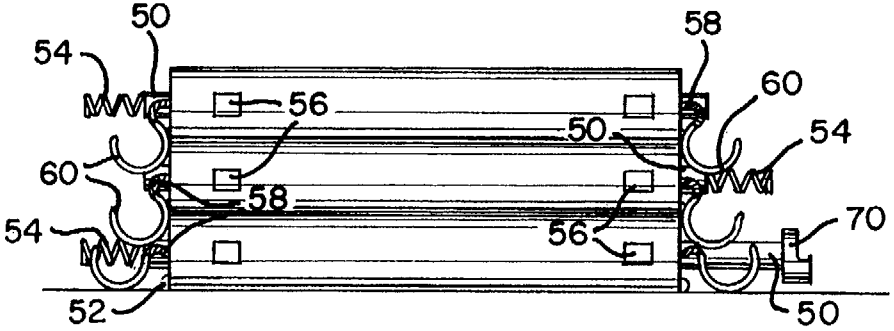
FIG. 6 shows a plurality of flexible band sections used for forming the enclosure wall of FIG. 5 in a transporting condition.

When the enclosure is no longer needed, the wall sections are wound up on shaft 50 by motor 64. The posts can be removed from the support member 22 by lifting them. The posts can also be disengaged from the shafts 50 and the springs 54 because the open top passages in the posts for the springs. The post may be slid out of the hooks 60, the hooks may be open or the hooks may be openable for removal of the posts. Once the posts are removed, the shafts, with the flexible material rolls up on them, may be folded as shown in FIG. 6 into a compact package. FIG. 7 is a bird's eye view of a four lane highway, depicting the location of the plastic enclosure at the scene of an auto accident.

Figure 8A:
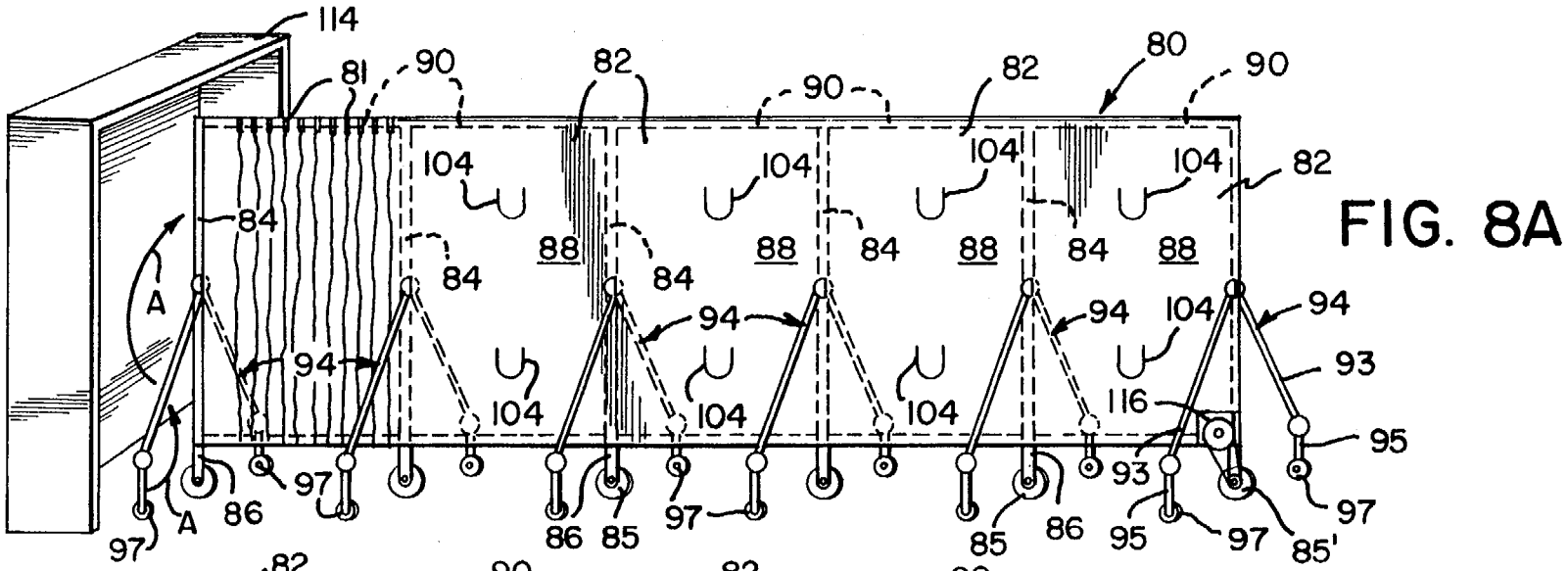
FIGS. 8A and 8B show elevation views of high wall enclosures according to the invention.
Figure 8B:
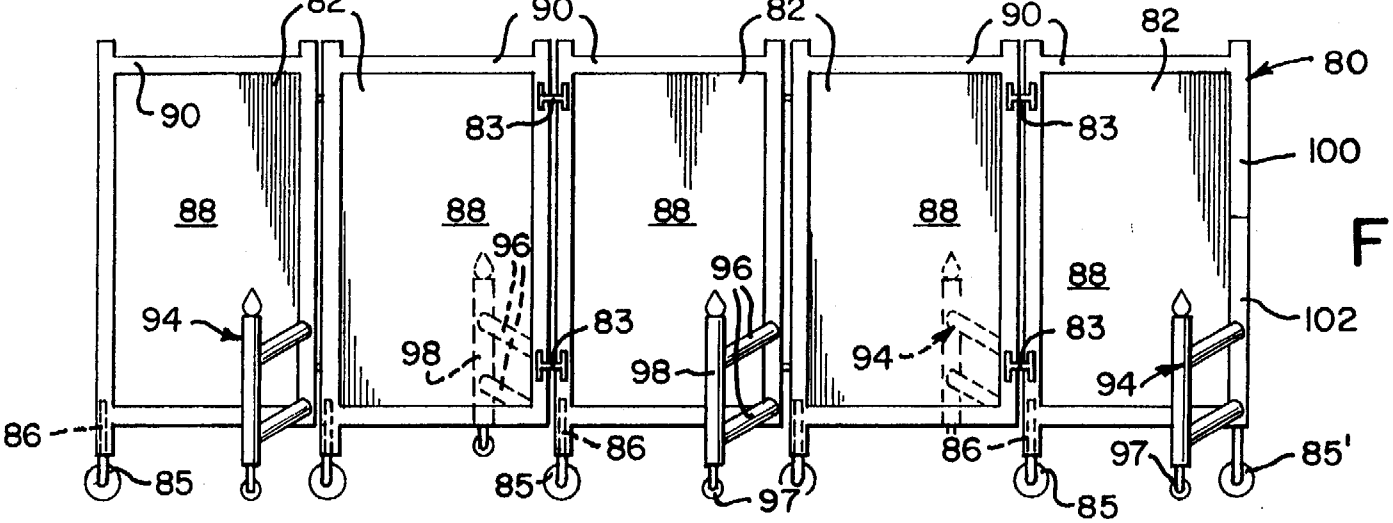

FIGS. 8A and 8B illustrate two embodiments of a tall enclosure wall 80. Similar to the enclosure wall 10 of FIG. 1, the wall 80 has a plurality of sections 82, each defined by a pair of vertical post members 84 received in support members 86. Instead of weighted disks as in FIG. 1, the support members 86 are formed as heavy wheels 85. In order to prevent the wheel from rolling, locks must be provided on at least some of these wheels. The wall material 88 may be as shown in FIG. 8A or rigid, e.g. a plastic sheet as shown in FIG. 8B.

When a flexible material is used as in FIG. 8A, it may be provided with hooks 81 along its top edge which slide along horizontal bars 90 connected between the upper edges of posts 84. This provides intermediate support for the flexible wall material. With this arrangement, the posts 84 and bars 90 form rectangular frames. In order to allow the wall to be folded for storage, without disassembling the frames, hinges 83 connect the frames.

In a typical embodiment, the top of the enclosure wall 80 is about seven (7) feet above the ground when the enclosure is fully erected. The typical width of the sections 82 is about three (3) feet. With such a high wall and with opaque wall material, the public's view of an enclosed area will be blocked. Such a wall is useful in preventing premature disclosure of evidence at a crime scene. It is also helpful in crowd control. If a celebrity, either famous or infamous, must be moved, e.g., from a building to a vehicle, there is often a crown surge when the celebrity appears. By blocking the crowd's view of the passage from the building, e.g. a court, hotel or arena, to the waiting vehicle, the crowd will not know when the celebrity is approaching the vehicle and it will be easier for security personnel to control the crowd, since a crowd surge will usually not occur.

With a tall enclosure wall as shown in FIGS. 8A and 8B, there is a greater tendency for it to tip over. One way to prevent this is by means of legs 94 that extend laterally from the wall at the location of each post. In one embodiment (shown in FIG. 8A) these legs have a downwardly sloping portion 93 and a vertically downward portion 95. To aid in positioning the wall, wheels 97 may be located on the legs where they contact the ground. In the second embodiment shown in FIG. 8B the legs may have horizontal projections 96 that meet vertical members 98, with the wheels 97 at the lower end of vertical members 98.

The legs may extend from both sides of each post member 84 as shown in the embodiment in FIG. 8A. As an alternative, the legs may project from only one side of each post or a parallel member 85, with the side alternating from post to post, as shown in FIG. 8B. Also, the various leg sections may be hinged together so they can be folded up against the posts, e.g., in the direction shown by arrow A in FIG. 8A. In addition, the posts, bars or legs can be made of telescoping sections, e.g. sections 100,102, which will further allow the wall to be reduced in size for storage.

A tall wall is subject to increased wind pressure which might tip it over. In order to reduce the effect of wind, small slits 104 or openings of other shapes may be formed in the wall material. These slits are made large enough to allow wind to pass through the wall, reducing the pressure on the wall, but small enough to limit significantly the ability to see through the wall.

While various materials may be used for the posts, bars and legs of the various embodiments of the invention, e.g. steel, aluminum or wood, it is preferred to use a form of durable plastic, such as PVC (polyvinylchloride) tubing. Such a material is relatively light in weight, strong and rust resistant. Also, it is less likely to mar other surfaces when being stored, e.g. in a trunk or store room, or to be marred. In addition, the flexible material may be canvas or vinyl.

Figure 9A:
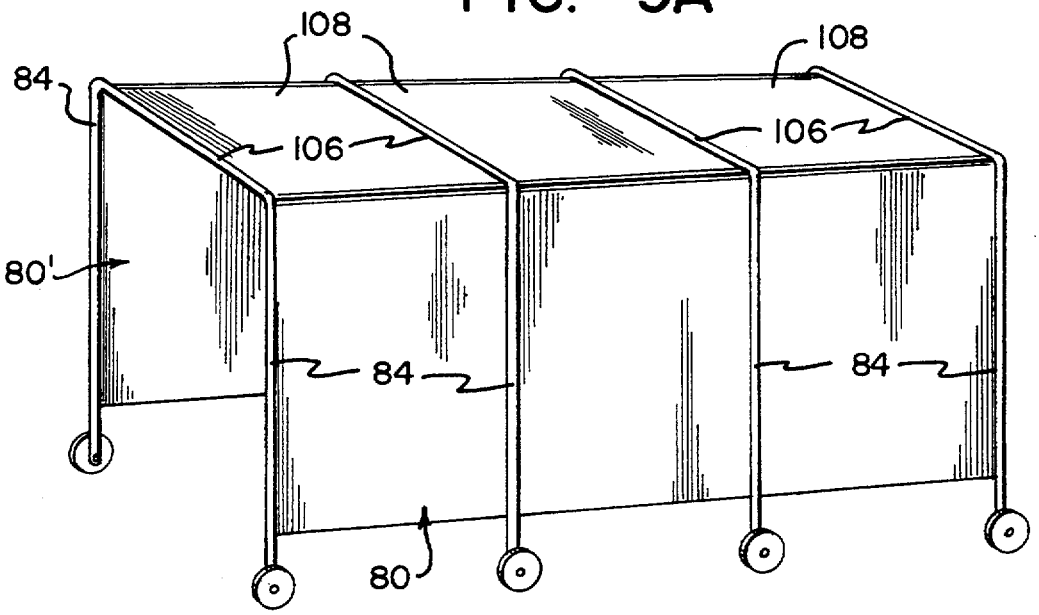
FIGS. 9A and 9B show perspective views of embodiments of the invention used as canopies.
Figure 9B:
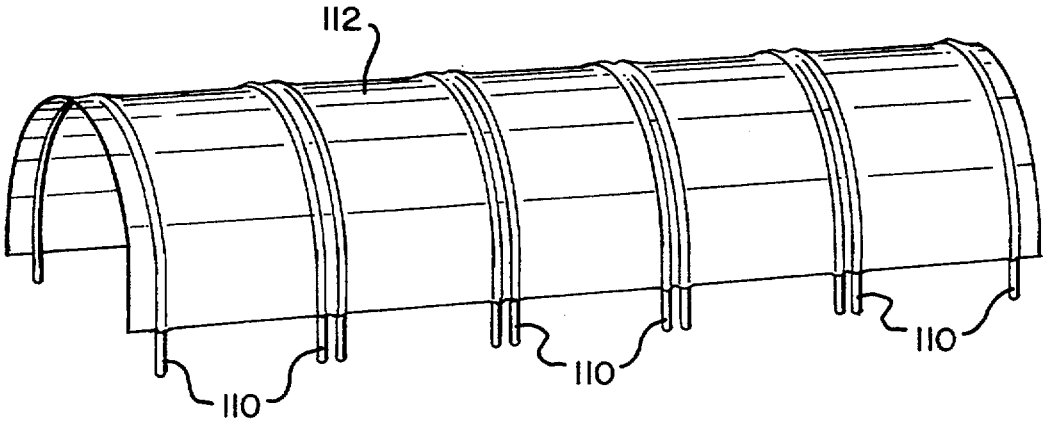

If the walls 80, 80' are used and are connected at their top by support bars 106 and wall material 108, the wall can be converted into a canopy which provides protection from the weather. Such a canopy is shown in FIG. 9A. Also, the same general structure may be designed as a canopy if it utilizes large inverted U-shaped posts 110 covered with material 12 as shown in FIG. 9B.

Whether a single wall or a canopy, the extension and retraction of the unit may be motorized. If the unit is normally stored in a housing 114 (FIG. 8A) and the wheels 85' on the outermost section are fixed so they cannot pivot about the axis of the post, an electric drive motor 116 may be connected to that wheel. Applying a drive force to that wheel will cause the wall, stored in according fashion, to unfold. Reversing the motor will cause it to retract. The other wheels 85 are free to pivot to accommodate the motion necessary to fold and unfold the accordion shape.

While particular embodiments of the invention have been shown and described, various modifications thereof will be apparent to those skilled in the art and, therefore, it is not intended that the invention be limited to the disclosed embodiments or details thereof, and the departure may be made therefrom within the spirit and scope of the invention as defined in the appended claims.

What is claimed is:

1. A portable area security wall structure comprising:

a wall comprised of a plurality of sections having predetermined lengths and widths, said wall being formed of a flexible band of material having longitudinally-spaced pocket means extending at least partially along the width of said band defining said plurality of sections, said band being continuous and being made of a light-reflecting material, said pocket means being formed integrally with said band;

a plurality of post members for mounting said wall on the ground, adjacent sections of said wall having cooperating means at adjacent longitudinal ends thereof for attachment of the adjacent sections to respective post members, said pocket means receiving said post members; and a plurality of weighted post support members for supporting said post members, and thereby said wall, on the ground, each of said post support members having an opening for receiving a lower end of a post member in an erected condition of said wall.

2. A portable area security wall structure as set forth in claim 1 wherein each of said plurality of sections comprises a substantially rectangular plate having hinge means at opposite longitudinal ends thereof defining at least partially said cooperating means.

3. A portable area security wall structure as set forth in claim 1 wherein each of said plurality of sections is made of a light-reflecting plastic material.

4. A portable area security wall structure as set forth in claim 1 wherein one of said longitudinal edges of said band has a folded portion fastened to the main portion of said band and forming a plurality of blind holes corresponding to the number and position of said plurality of pockets for receiving upper ends of respective post members in the erected condition of the enclosure wall.

5. A portable area security wall structure as set forth in claim 1 wherein said post members are freely received in said pockets.

6. A portable area security wall structure as set forth in claim 1 wherein said post members are fixedly secured in said pockets.

7. A portable area security wall structure as set forth in claim 1 wherein said support members have wheels.

8. A portable area security wall structure as set forth in claim 1 wherein said enclosure wall is a band of flexible material having slits in it to allow wind to pass through the wall.

9. A portable area security wall structure as set forth in claim 8 wherein the slits have a U shape.

10. A portable area security wall structure as set forth in claim 1 wherein the wall structure may be folded accordion style, and further including a housing in which said folded wall structure may be stored.

11. A portable area security wall structure as set forth in claim 1 further including:

a second wall supported by a plurality of second post members, said second post members being supported on the ground by second support members, roof bars connecting the tops of the posts of said wall to the tops of posts of said second wall, and roof material supported by said roof bars, whereby a canopy is formed.

12. A portable area security wall structure as set forth in claim 10 wherein the connected posts of the wall, posts of the second wall and roof bars are formed as a continuous curved member.

13. A portable area security wall structure as set forth in claim 10 wherein the support members have wheels.

14. A portable area security wall structure as set forth in claim 10 further including a housing and wherein the canopy has an inner section and an outer section with the outer section being outermost when stored in the housing, the wall and roof material being flexible so the canopy may be folded and stored in the housing.

15. A portable area security wall structure as set forth in claim 14 further including an electric motor and wherein the support members have wheels, at least one wheel on the outer section being driven by the electric motor.

16. A portable area security wall structure comprising:

a wall comprised of a plurality of sections having predetermined lengths and widths;

a plurality of post members for mounting said wall on the ground, adjacent sections of said wall having cooperating means at adjacent longitudinal ends thereof for attachment of the adjacent sections to respective post members; and a plurality of weighted post support members for supporting said post members, and thereby said wall, on the ground, each of said post support members having an opening for receiving a lower end of a post member in an erected condition of said wall, each of said plurality of sections including a shaft member and a panel made of a flexible material, said flexible material having fixedly attached at one of its opposite longitudinal edges to said shaft member, said wall structure further comprising a plurality of flexible rotational torque transmitting members extending through respective post members for rotatably connecting shaft members of adjacent sections with each other, and drive means for rotating said shaft members in opposite directions to thereby unwind and wind said enclosure wall.

17. A portable area security wall structure as set forth in claim 16 wherein each of said flexible rotational torque transmitting members is a wound coil spring detachably secured between ends of respective shaft members.

18. A portable area security wall structure as set forth in claim 16 wherein said drive means comprises an electric motor and quick disconnect coupling means for connecting said electric motor with one of said shaft members.

19. A portable area security wall structure as set forth in claim 16 wherein each of said plurality of sections includes a stiffening rod secured at opposite longitudinal edges of a respective panel.

20. A portable area security wall structure as set forth in claim 1 wherein said band has opposite end sections, each of said end sections having an outer end and hook-like means at said outer ends cooperating with hinge hook-like means of the other of said opposite end sections for receiving a post member, said sections being arranged to enclose an area so that the end sections abut each other, one of said end sections serving as a door and having means for stiffening said door.

21. A portable area security wall structure as set forth in claim 20 wherein said stiffening means comprises two pairs of diagonally opposed pockets formed integrally with said one end section and two rod members received in said two pairs of pockets, respectively.

22. A portable area security wall structure comprising:

a wall comprised of a plurality of sections having predetermined lengths and widths;

a plurality of post members for mounting said wall on the ground, adjacent sections of said wall having cooperating means at adjacent longitudinal ends thereof for attachment of the adjacent sections to respective post members;

a plurality of weighted post support members for supporting said post members, and thereby said wall, on the ground, each of said post support members having opening for receiving a lower end of a post member in an erected condition of said wall; and at least one leg projecting from a post for providing lateral stability to the wall.

23. A portable area security wall structure as set forth in claim 22 wherein each post has one leg projecting therefrom, a leg on a post being on the opposite side of the wall from the legs on the adjacent posts.

24. A portable area security wall structure as set in claim 22 wherein there are legs projecting from both sides of each post.

25. A portable area security wall structure as set forth in claim 22 wherein the leg has a vertical section with a top end and a bottom end extending to the ground, said vertical section being at a distance from the posts, and at least one generally horizontal section extending from the top end of the vertical section to the post.

26. A portable area security wall structure as set forth in claim 25 wherein the generally horizontal section is at an angle to the horizontal.

27. A portable area security wall structure as set forth in claim 25 wherein the generally horizontal section is a horizontal bar extending from the end of the vertical section and further including a second horizontal section extending from a location between the ends of the vertical section to the post.

28. A portable area security wall structure as set forth in claim 22 further including a wheel at the bottom of the vertical section.

29. A portable area security wall structure as set forth in claim 22 wherein the vertical and generally horizontal sections are pivotally connected to the leg and can be folded against the post for storage.

30. A portable area security wall structure as set forth in claim 22 wherein at least one of the post and leg is made of telescoping sections.

31. A portable area security wall structure as set forth in claim 22 further including bars extending between the upper ends of the posts, and wherein at least one of the post, bar and leg is made of telescoping sections and the wall is formed of flexible material supported by the bar.

32. A portable area security wall structure comprising:

a wall comprised of a plurality of sections having predetermined lengths and widths;

a plurality of post members for mounting said wall on the ground, adjacent sections of said wall having cooperating means at adjacent longitudinal ends thereof for attachment of the adjacent sections to respective post members; and a plurality of weighted post support members for supporting said post members, and thereby said wall, on the ground, each of said post support members having an opening for receiving a lower end of a post member in an erected condition of said wall, the wall structure may be folded accordion style;

a housing in which said folded wall structure may be stored, the post supports being wheels, the wall structure having two end sections, one end section being innermost in the housing and one end section being outermost when said wall structure is stored in the housing; and an electric motor coupled to the wheel on the outermost section for withdrawing the wall structure from, and returning the wall section to, the housing by means of rotation of the wheel by the electric motor.

* * * * *